US009041301B2

(12) United States Patent
Park

(10) Patent No.: US 9,041,301 B2
(45) **Date of Patent: *May 26, 2015**

(54) LED FLUORESCENT LAMP

(71) Applicant: KUMHO ELECTRIC, INC., Seoul (KR)

(72) Inventor: Myung Koo Park, Seoul (KR)

(73) Assignees: KUMHO ELECTRIC, INC., Seoul (KR); Myung Koo Park, Seoul (KR)

( * ) Notice: Subject to any disclaimer, the term of this patent is extended or adjusted under 35 U.S.C. 154(b) by 95 days.

This patent is subject to a terminal disclaimer.

(21) Appl. No.: 13/778,755

(22) Filed: Feb. 27, 2013

(65) Prior Publication Data

US 2014/0239827 A1 Aug. 28, 2014

(51) Int. Cl.
*H05B 37/00* (2006.01)
*H05B 33/08* (2006.01)

(52) U.S. Cl.
CPC ..... *H05B 33/0809* (2013.01)

(58) Field of Classification Search
CPC ..... H05B 37/02; H05B 33/08; H05B 37/00; H05B 33/02; F21S 4/001
USPC ..... 315/291, 307, 312, 185 R, 185 S, 200 R, 315/192, 187–188
See application file for complete search history.

(56) References Cited

U.S. PATENT DOCUMENTS

| | | | | |
|---|---|---|---|---|
| 5,936,599 | A * | 8/1999 | Reymond | 345/82 |
| 6,461,019 | B1 * | 10/2002 | Allen | 362/249.06 |
| 7,276,858 | B2 * | 10/2007 | Allen | 315/205 |
| 7,344,275 | B2 * | 3/2008 | Allen et al. | 362/249.01 |
| 7,501,772 | B2 * | 3/2009 | Chung et al. | 315/185 R |
| 8,148,905 | B2 * | 4/2012 | Miskin et al. | 315/185 R |
| 8,358,056 | B2 * | 1/2013 | Park | 313/498 |
| 2012/0233854 | A1 * | 9/2012 | Yu et al. | 29/825 |

FOREIGN PATENT DOCUMENTS

| | | | |
|---|---|---|---|
| JP | 2008-263203 | A | 10/2008 |
| KR | 10-0933076 | B1 | 12/2009 |
| KR | 10-0935996 | B1 | 1/2010 |
| KR | 10-2010-0042323 | A | 4/2010 |
| KR | 10-2010-0049881 | A | 5/2010 |

* cited by examiner

*Primary Examiner* — Minh D A

(57) ABSTRACT

A light emitting diode (LED) fluorescent lamp includes an external connection pin including a first connection pin and a second connection pin, an LED array including a plurality of light emitting diodes (LEDs) connected in series, a current stabilizing capacitor connected in parallel to the LED array, and a capacitive element unit connected between the LED array and the external connection pin and configured to vary an impedance of a fluorescent lamp ballast connected to the capacitive element unit through the external connection pin.

12 Claims, 7 Drawing Sheets

LED FLUORESCENT LAMP

BACKGROUND

1. Field of the Invention

The present invention relates to a light emitting diode (LED) fluorescent lamp, and more particularly, to a long-lived highly efficient LED fluorescent lamp having an internal structure capable of intactly using a ballast of a conventional fluorescent lamp.

2. Discussion of Related Art

With technical developments, the optical efficiency of a light emitting diode (LED) conventionally used only for low-power indicator lights such as an indicator is increasing to the extent that the LED may be useful in actual life. Also, since the LED is an environmentally friendly light source free of mercury (Hg) unlike other light sources, the LED has attracted much attention as an advanced light source for backlights for portable phones, backlights for liquid crystal display televisions (LCD TVs), vehicle lamps, or general illuminators. Since the 2000s, the unit cost of generation of power has started to jump due to a sudden rise in crude oil prices. With the rise of environmental problems, an incandescent lamp or fluorescent lamp that has been used as a main light source of an illumination system for the past 100 years is being superseded by an LED lamp.

However, although an LED lamp may be directly substituted for an incandescent lamp, such as an E26 base compatible lamp, when an LED lamp is substituted for a fluorescent lamp, which makes up a large portion of general illuminators, a lighting fixture should be changed or a ballast exclusively for fluorescent lamp should be installed individually. Accordingly, some difficulties of, for example, changing lines disposed in the lighting fixture may be caused, so the usage of LED fluorescent lamps is not increasing.

SUMMARY OF THE INVENTION

The present invention is directed to providing a light emitting diode (LED) fluorescent lamp, which may prevent an LED from performing high-frequency on/off switch operations to maximize the lifespan of the LED fluorescent lamp, minimize a crest factor of an LED operating current to enhance optical efficiency of the LED fluorescent lamp, and be applied to ballasts for conventional fluorescent lamps without additionally changing ballasts or lines.

One aspect of the present invention provides an LED fluorescent lamp including: an external connection pin including a first connection pin and a second connection pin, an LED array including a plurality of light emitting diodes (LEDs) connected in series, a current stabilizing capacitor connected in parallel to the LED array, and a capacitive element unit connected between the LED array and the external connection pin and configured to vary an impedance of a fluorescent lamp ballast connected to the capacitive element unit through the external connection pin.

In another aspect, the external connection pin may further include a third connection pin and a fourth connection pin. The capacitive element unit may include at least one of a first capacitor having one end connected to the first connection pin and the other end connected to a terminal of an anode side of the LED array, a second capacitor having one end connected to the second connection pin and the other end connected to a terminal of a cathode side of the LED array, a third capacitor having one end connected to the third connection pin and the other end connected to the terminal of the anode side of the LED array, and a fourth capacitor having one end connected to the fourth connection pin and the other end connected to the terminal of the cathode side of the LED array.

In another aspect, the LED fluorescent lamp may further include a diode unit connected to both ends of the LED array and configured to form a one-way current path in the LED array.

BRIEF DESCRIPTION OF THE DRAWINGS

The above and other objects, features and advantages of the present invention will become more apparent to those of ordinary skill in the art by describing in detail exemplary embodiments thereof with reference to the attached drawings, in which.

DETAILED DESCRIPTION OF EXEMPLARY EMBODIMENTS

Hereinafter, exemplary embodiments of the present invention will be described in detail. However, the present invention is not limited to the embodiments disclosed below, but can be implemented in various forms. The following embodiments are described in order to enable those of ordinary skill in the art to embody and practice the present invention.

Although the terms first, second, etc. may be used to describe various elements, these elements are not limited by these terms. These terms are only used to distinguish one element from another. For example, a first element could be termed a second element, and, similarly, a second element could be termed a first element, without departing from the scope of exemplary embodiments. The term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

The terminology used herein is for the purpose of describing particular embodiments only and is not intended to be limiting of exemplary embodiments. The singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, components and/or groups thereof, but do not preclude the presence or addition of one or more other features, integers, steps, operations, elements, components and/or groups thereof.

With reference to the appended drawings, exemplary embodiments of the present invention will be described in detail below. To aid in understanding the present invention, like numbers refer to like elements throughout the description of the figures, and the description of the same elements will be not reiterated.

Figure 1:
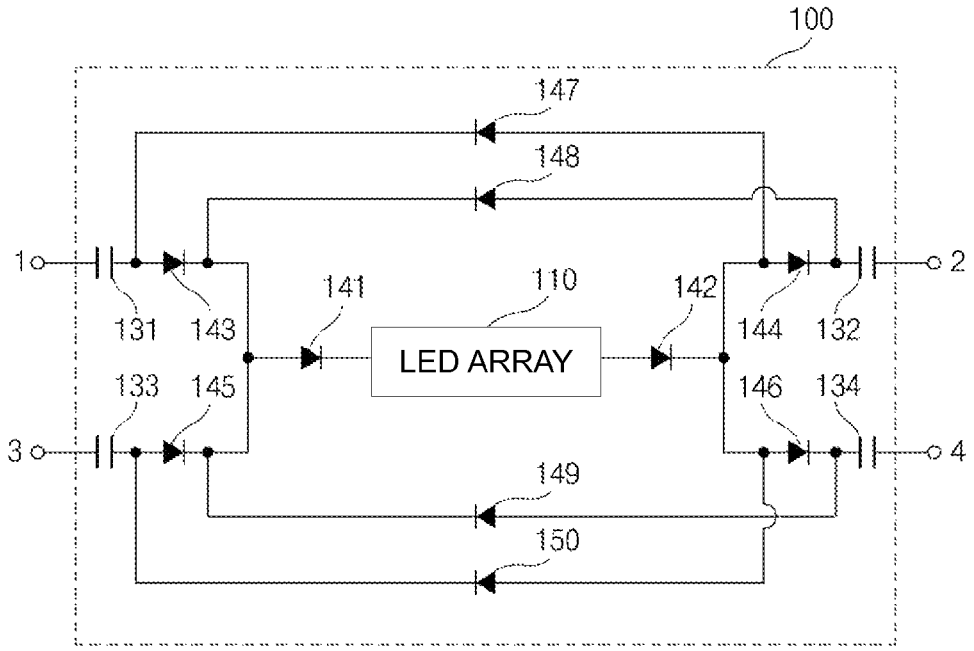
FIG. 1 is a basic construction diagram of a light emitting diode (LED) fluorescent lamp.

FIG. 1 is a construction diagram of a light emitting diode (LED) fluorescent lamp 100. The LED fluorescent lamp 100 may include an LED array 110, a plurality of capacitors 131, 132, 133, and 134, and a plurality of diodes 141, 142, 143, 144, 145, 146, 147, 148, 149, and 150. Even if the LED fluorescent lamp is directly connected to a ballast for a conventional fluorescent lamp using the plurality of capacitors 131, 132, 133, and 134 and the plurality of diodes 141, 142, 143, 144, 145, 146, 147, 148, 149, and 150, the LED fluorescent lamp may operate. The operation and characteristics of the LED fluorescent lamp 100 are described in detail in Korean Patent Registration No. 0981854. In the present specification, the term 'LED fluorescent lamp' refers to a fluorescent lamp using an LED as a light source. The LED fluorescent lamp may have various exterior shapes, such as a straight shape or a curved shape.

Figure 2:
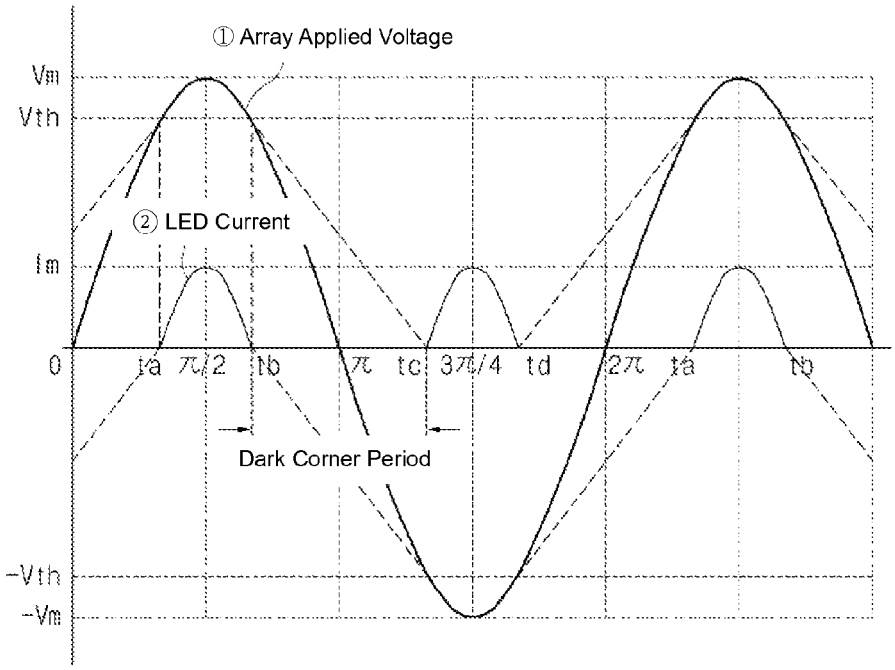
FIG. 2 is a graph showing the waveforms of a voltage applied to an LED fluorescent lamp and current supplied to an LED array.

FIG. 2 is a graph showing a waveform ① of a voltage applied to the LED array 110 and a waveform ② of current supplied to the LED array 110 when the LED fluorescent lamp 100 shown in FIG. 1 is driven using an electronic ballast configured to operate high-frequency operations.

Referring to FIG. 2, the waveform ① of the voltage applied to the LED array 110 may have a sine curve shape, and the current ② may flow into the LED array 110 only during a period in which the applied voltage is equal to or higher than a threshold voltage Vth of the LED array 110. Accordingly, in a period tb-tc in which the applied voltage is lower than the threshold voltage Vth of the LED array 110, dark period at which current is not supplied to the LED array 110 may occur, thereby degrading optical efficiency of the entire LED array 110. Also, an in-rush current may flow due to on/off operations every cycle, thereby shortening the lifespan of the LED fluorescent lamp.

Figure 3:
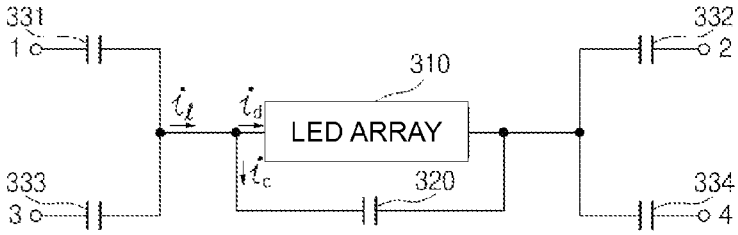
FIG. 3 is a circuit diagram of an LED fluorescent lamp according to an exemplary embodiment of the present invention.

FIG. 3 is a circuit diagram of an LED fluorescent lamp 300 according to an exemplary embodiment of the present invention.

The LED fluorescent lamp 300 may include first through fourth external connection pins 1, 2, 3, and 4, an LED array 310, a current stabilizing capacitor 320, and a capacitive element unit 331, 332, 333, and 334.

The LED array 310 may include a plurality of LEDs connected in series. A plurality of groups of a plurality of LEDs connected in series may be connected in parallel. The LED array 110 used in the present embodiment may be variously configured, and each of the LEDs may be an LED chip, a single package in which a plurality of LED chips are mounted, or a chip-on-board (COB) package.

Among the external connection pins 1, 2, 3, and 4, the first external connection pin 1 and the third external connection pin 3 may be formed at one end of an anode side of the LED array 310, while the second external connection pin 2 and the fourth external connection pin 4 may be formed at the other end of a cathode side of the LED array 310.

The first through fourth external connection pins 1, 2, 3, and 4 may be used to mount the LED fluorescent lamp according to the present embodiment on a conventional lighting fixture for a fluorescent lamp. Depending on a shape of a ballast mounted on the conventional lighting fixture for the fluorescent lamp, all of the four external connection pins 1, 2, 3, and 4 may be connected to the ballast or one of the external connection pins connected to the one end of the LED array 310 and another one of the external connection pins connected to the other end of the LED array 310 may be connected to the ballast. Also, the first external connection pin 1 and the third external connection pin 3 connected to the one end of the LED array 310 may be shorted and used as a single external connection pin, while the second external connection pin 2 and the fourth external connection pin 4 connected to the other end of the LED array 310 may be shorted and used as the other external connection pin.

The capacitive element unit 331, 332, 333, and 334 may be connected to a circuit of an electronic ballast for fluorescent lamps through the external connection pins 1, 2, 3, and 4 and serve to change a resonant frequency of a serial resonance circuit including an inductor and a capacitor or control current flowing into the LED array 310. In the present embodiment, the capacitive element unit 331, 332, 333, and 334 may include a first capacitor 331 having one end connected to the first connection pin 1 and the other end connected to a terminal of the anode side of the LED array 310, a second capacitor 332 having one end connected to the second connection pin 2 and the other end connected to a terminal of the cathode side of the LED array 310, a third capacitor 333 having one end connected to the third connection pin 3 and the other end connected to the terminal of the anode side of the LED array 310, and a fourth capacitor 334 having one end connected to the fourth connection pin 4 and the other end connected to the terminal of the cathode side of the LED array 310.

FIG. 3 illustrates a case (a) in which the first and third external connection pins 1 and 3 are opened and the second and fourth external connection pins 2 and 4 are opened. However, when the LED fluorescent lamp 300 according to the present embodiment is connected to an instant start ballast, to obtain more stable, uniform optical characteristics, the first and third external connection pins 1 and 3 may be shorted (case (b)) or the second and fourth external connection pins 2 and 4 may be shorted (case (c)). Alternatively, the first and third external connection pins 1 and 3 may be shorted and simultaneously, the second and fourth external connection pins 2 and 4 may be shorted (case (d)).

When the LED fluorescent lamp 300 is connected to an instant start electronic ballast, assuming that each of the capacitors 331 to 334 respectively connected to the external connection pins 1, 2, 3, and 4 has a capacitance $C_1$, a frequency of a voltage applied from the electronic ballast has an angular velocity ω, and a capacitor disposed in the electronic ballast has a much higher capacitance than the capacitance $C_1$, current flowing through the LED array 310 may be controlled by a complex impedance given by:

$$j\frac{2}{\omega C_1}$$

(in case (a)), $$j\frac{3}{2\omega C_1}$$

(in cases (b) and (c)), or $$j\frac{1}{\omega C_1}$$

(in case (d)).

The current stabilizing capacitor 320 may have one end connected to one end of the LED array 310 and the other end connected to the other end of the LED array 310 so that the current stabilizing capacitor 320 can be connected in parallel to the LED array 310.

On analysis of basic operations of the current stabilizing capacitor 320, current flowing through the LED fluorescent lamp 300 according to Kirchhoff's Law may be given by:

$$i_l = i_d + i_c \quad (1),$$

wherein $i_l$ denotes current flowing from an external ballast through the external connection pins 1, 2, 3, and 4 into the LED fluorescent lamp 300, $i_d$ denotes current flowing through the LED array 310, and $i_c$ denotes current flowing through the current stabilizing capacitor 320.

In this case, assuming that a capacitance of the current stabilizing capacitor 320 connected in parallel to both ends of the LED array 310 is several tens of microfarads (μF) or more to enable supply of a sufficient current to the LED array 310, an even direct current (DC) may be always supplied into the LED array 310 due to the current stabilizing capacitor 320.

Equation: $i_d = i_l - i_c$ may be obtained from Equation 1, and the current $i_d$ flowing through the LED array 310 may be expressed by a value obtained by subtracting the current $i_c$ flowing through the current stabilizing capacitor 320 from the current $i_l$ supplied from the ballast, that is, the current $i_d$ may be expressed by a value obtained by applying to the current $i_l$ a reverse bias corresponding to the current $i_c$.

Accordingly, assuming that the current stabilizing capacitor 320 has a sufficiently large capacitance, an even DC may flow into load of the LED array 310 due to the current stabilizing capacitor 320. As a result, occurrence of dark-corner periods of an operating current due to a pulsating voltage element supplied from the ballast, as shown in FIG. 2, may be prevented. Also, since the DC flows through the LED array 310, the light velocity efficiency of the LED fluorescent lamp may be improved due to a reduction in the crest factor of current. Furthermore, occurrence of an in-rush current due to on/off operations of the LED array 310 may be prevented every cycle, thereby enabling long-term use of the LED fluorescent lamp.

Each of LED fluorescent lamps that will be described below may equally include an LED array and a current stabilizing capacitor connected in parallel to the LED array. Accordingly, a repeated description of the LED array and the current stabilizing capacitor will be omitted, and characteristic constructions and operations of each of the LED fluorescent lamps will chiefly be described.

Figure 4:
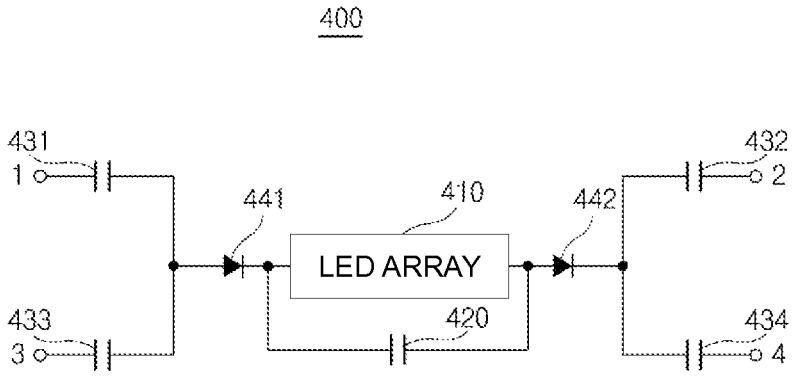
FIG. 4 is a circuit diagram of an LED fluorescent lamp according to another exemplary embodiment of the present invention.

FIG. 4 is a circuit diagram of an LED fluorescent lamp according to another exemplary embodiment of the present invention.

Referring to FIG. 4, unlike the LED fluorescent lamp 300 shown in FIG. 3, a first diode 441 and a second diode 442 may be further connected in series to both ends of the LED array 410. The first diode 441 and the second diode 442 may allow current to flow into the LED array 410 only in a forward direction. Accordingly, when a zener diode is connected in parallel to LEDs of the LED array 410 in a reverse direction, occurrence of power loss caused by the flow of current through the zener diode during a minus (−) period may be prevented. Although the present embodiment describes an example in which the LED fluorescent lamp 400 includes two diodes 441 and 442, one of the two diodes 441 and 442 may be connected to the LED array 410 according to usage environments.

Figure 5:
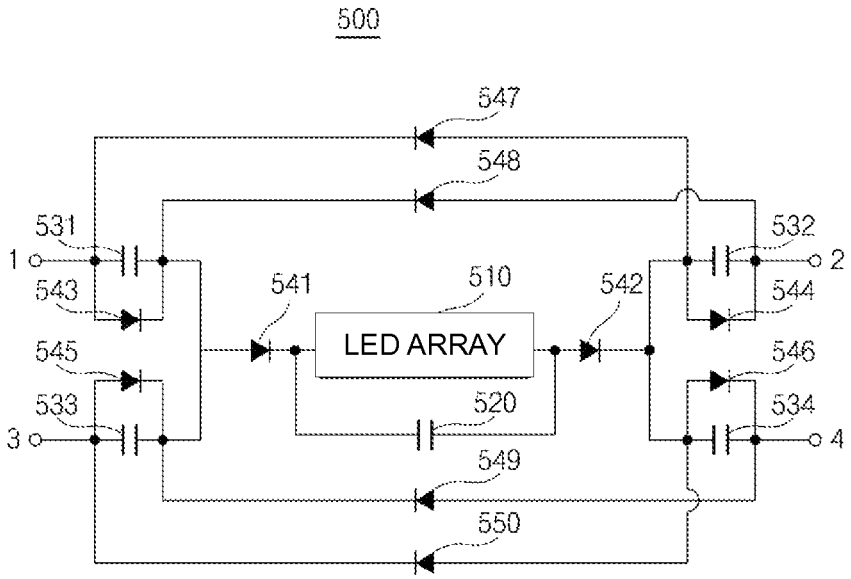
FIG. 5 is a circuit diagram of an LED fluorescent lamp according to another exemplary embodiment of the present invention.

FIG. 5 is a circuit diagram of an LED fluorescent lamp 500 according to another exemplary embodiment of the present invention.

Referring to FIG. 5, unlike the LED fluorescent lamp 400 shown in FIG. 4, the LED fluorescent lamp 500 according to the present embodiment may further include third through tenth diodes 543 to 550. In the present embodiment, both ends of third, fourth, fifth, and sixth diodes 543, 544, 545, and 546 may be respectively connected to both ends of first, second, third, and fourth capacitors 531, 532, 533, and 534 so that the third, fourth, fifth, and sixth diodes 543, 544, 545, and 546 can be connected in parallel to the first through fourth capacitors 531, 532, 533, and 534. The third through sixth diodes 543, 544, 545, and 546 may be shorted or opened depending on the phase of a voltage applied from an electronic ballast so that the parallel-connected first through fourth capacitors 531, 532, 533, and 534 and a serial resonance capacitor C disposed in the electronic ballast may be combined and change a complex impedance for controlling current.

When the LED fluorescent lamp 500 according to the present embodiment is connected to a half bridge ballast for fluorescent lamps, which has a serial resonance circuit, the third and fourth external connection pins 3 and 4 may be respectively connected to a switching output point and a power supply terminal of an inverter disposed in the ballast, and the first and second external connection pins 1 and 2 may be connected to the serial resonance capacitor C disposed in the ballast. In this case, when the third external connection pin 3 has a higher electric potential than the fourth external connection pin 4, current may flow through the third external connection pin 3, the fifth diode 545, the first capacitor 531, the serial or external resonance capacitor C, the second capacitor 532, and the sixth diode 546. When the third external connection pin 3 has a lower electric potential than the fourth external connection pin 4, current may flow through the fourth external connection pin 4, the fourth capacitor 534, the fourth diode 544, the serial or external resonance capacitor C, the third diode 543, the third capacitor 533, and the third external connection pin 3. By changing capacitances of the four capacitors 531 to 534, a composite impedance including at least some of the fourth capacitors 531 to 534 and the serial or external resonance capacitor C that are connected in series may be changed to control the flow of current into an LED array 510.

The seventh through tenth diodes 547, 548, 549, and 550 may allow a forward current to flow into the LED array 510 irrespective of a change in the phase of an AC voltage in various ballasts for fluorescent lamps so that the LED fluorescent lamp can operate.

In a modified example of the present embodiment, one end of the current stabilizing capacitor 520 may be connected to an anode of the first diode 541, and the other end of the current stabilizing capacitor 520 may be connected to a cathode of the second diode 542.

Figure 6:
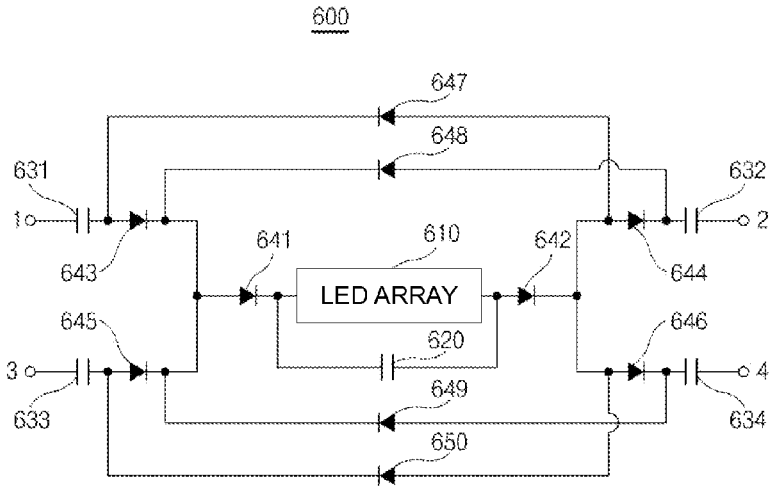
FIG. 6 is a circuit diagram of an LED fluorescent lamp according to another exemplary embodiment of the present invention.

FIG. 6 is a circuit diagram of an LED fluorescent lamp 600 according to another exemplary embodiment of the present invention.

Unlike the LED fluorescent lamp 500 shown in FIG. 5, in the LED fluorescent lamp 600 according to the present embodiment, third through sixth diodes 643, 644, 645, and 646 may be connected in series to first through fourth capacitors 631, 632, 633, and 634, respectively. The third through sixth diodes 643, 644, 645, and 646 and the seventh through tenth diodes 647, 648, 649, and 650 may allow a forward current to flow into an LED array 610 irrespective of the phase of an AC voltage in various ballasts for fluorescent lamps so that the LED fluorescent lamp 500 according to the present embodiment can operate.

When the LED fluorescent lamp 600 according to the present embodiment is connected to an instant start ballast for electronic fluorescent lamps, a first external connection pin 1 and a second external connection pin 2 may be connected to an output line of the ballast, while a third external connection pin 3 and a fourth external connection pin 4 may be opened or shorted. An internal capacitor may be disposed in the ballast and connected in series to the first external connection pin 1 of the LED fluorescent lamp 600.

When an output is applied from an electronic ballast to the first external connection pin 1 and the second external connection pin 2 and a voltage of the first external connection pin 1 is higher than a voltage of the second external connection pin 2, current may flow through a current control capacitor disposed in the ballast, the first external connection pin 1, the first capacitor 631, the third diode 643, the first diode 641, the LED array 610, a current stabilizing capacitor 620, the second diode 642, the fourth diode 644, the second capacitor 632, and the second external connection pin 2. Conversely, when the voltage of the first external connection pin 1 is lower than the voltage of the second external connection pin 2, current may flow through the second external connection pin 2, the second capacitor 632, the eighth diode 648, the first diode 641, the LED array 610, the current stabilizing capacitor 620, the second diode 642, the seventh diode 647, the first capacitor 631, the first external connection pin 1, and the current control capacitor disposed in the ballast. That is, a value of current flowing through the LED array 610 and the current stabilizing capacitor 620 may be controlled by a serial complex impedance of a capacitor disposed in the electronic ballast, the first capacitor 631, and the second capacitor 632. Assuming that the capacitor disposed in the ballast has a capacitance of C and each of the first through fourth capacitors 631 to 634 has a capacitance of $C_1$, a complex impedance for controlling current flowing through the LED array 610 and the current stabilizing capacitor 620 may be given by:

$$Z = j\frac{2}{\omega C} + j\frac{2}{\omega C_1}.$$

In addition, when the third external connection pin 3 and the fourth external connection pin 4 are connected to the output line of the instant start ballast and the first external connection pin 1 and the second external connection pin 2 are opened, a direction of current may be controlled by the fifth, sixth, ninth, and tenth diodes 645, 646, 649, and 650 so that current can flow into the LED array 610. Similarly, a value of current flowing through the LED array 610 may be controlled by a serial complex impedance of the capacitor disposed in the ballast, the third capacitor 633, and the fourth capacitor 634 as described above, and the serial complex impedance may be given by:

$$Z = j\frac{1}{\omega C} + j\frac{2}{\omega C_1}.$$

Depending on the shape of the instant start ballast, the first external connection pin 1 and the third external connection pin 3 may be shorted and/or the second external connection pin 2 and the fourth external connection pin 4 may be shorted. In this case, a complex impedance for controlling current may be given by:

$$Z = j\frac{1}{\omega C} + j\frac{1}{\omega C_1}.$$

In a modified example of the present embodiment, one end of the current stabilizing capacitor 620 may be connected to an anode of the first diode 641, and the other end of the current stabilizing capacitor 620 may be connected to a cathode of the second diode 642.

Figure 7:
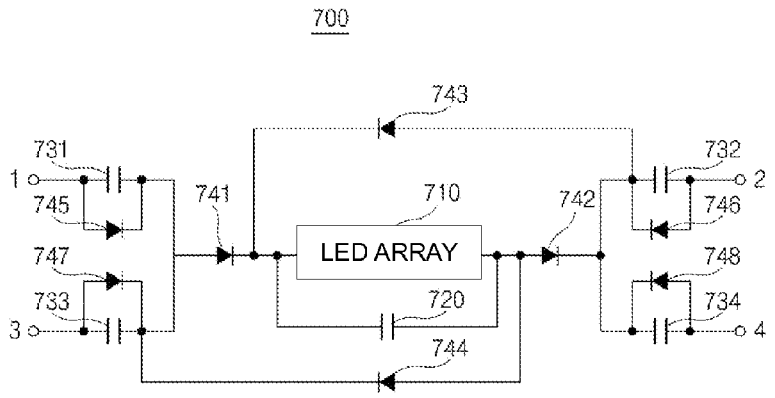
FIG. 7 is a circuit diagram of an LED fluorescent lamp according to another exemplary embodiment of the present invention.

FIG. 7 is a circuit diagram of an LED fluorescent lamp 700 according to another exemplary embodiment of the present invention.

Referring to FIG. 7, the LED fluorescent lamp 700 according to the present embodiment may include an LED array 710, a current stabilizing capacitor 720 connected in parallel to the LED array 710, first through fourth external connection pins 1, 2, 3, and 4, and first through fourth capacitors 731, 732, 733, and 734 having one ends respectively connected to the first through fourth external connection pins 1, 2, 3, and 4. The LED fluorescent lamp 700 may further include a diode unit disposed to allow flow of a forward current into the LED array 710.

The diode unit may include a first diode 741 having an anode connected to the other end of the first capacitor 731 and a cathode connected to one end of the LED array 710, a second diode 742 having an anode connected to the other end of the LED array 710 and a cathode connected to the other end of the second capacitor 732, a third diode 743 having an anode connected to the other end of the second capacitor 732 and a cathode connected to one end of the LED array 710, and a fourth diode 744 having an anode connected to the other end of the LED array 710 and a cathode connected to the other end of the third capacitor 733.

The first diode 741 may allow current supplied through the first external connection pin 1 or the third external connection pin 3 to flow into the LED array, while the second diode 742 may prevent current supplied through the second external connection pin 2 and the fourth external connection pin 4 from directly flowing in a reverse direction to the LED array 710. The third diode 743 may shift a path of current supplied through the second external connection pin 2 and the fourth external connection pin 4 so that current can flow into the LED array 710 in a forward direction. Also, the fourth diode 744 may allow current supplied through the second external connection pin 2 and the fourth external connection pin 4 to flow the first external connection pin 1 or the third external connection pin 3 through the LED array 710. That is, the third diode 743 and the fourth diode 744 may enable the LED fluorescent lamp according to the present embodiment to operate irrespective of a change in the phase of a voltage applied to the first through fourth connection pins 1, 2, 3, and 4 in various ballasts for fluorescent lamps.

FIG. 7 illustrates an embodiment in which the first and third external connection pins 1 and 3 are opened and the second and fourth external connection pins 2 and 4 are opened. However, when the LED fluorescent lamp according to the present embodiment is connected to an instant start ballast, to obtain more stable, uniform optical characteristics, the first and third external connection pins 1 and 3 may be shorted or the second and fourth external connection pins 2 and 4 may be shorted. Alternatively, the first and third external connection pins 1 and 3 may be shorted and simultaneously, the second and fourth external connection pins 2 and 4 may be shorted.

Figure 8:
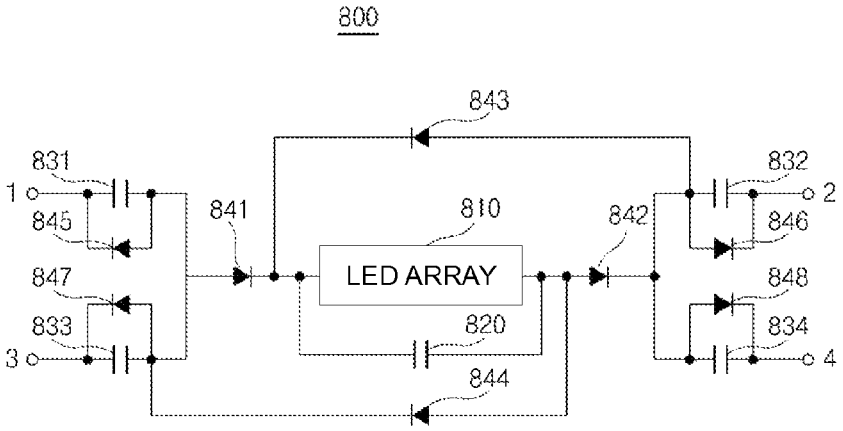
FIG. 8 is a circuit diagram of an LED fluorescent lamp according to another exemplary embodiment of the present invention.

FIG. 8 is a circuit diagram of an LED fluorescent lamp 800 according to another exemplary embodiment of the present invention.

Referring to FIG. 8, the LED fluorescent lamp 800 according to the present embodiment may include an LED array 810, a current stabilizing capacitor 820 connected in parallel to the LED array 810, first through fourth external connection pins 1, 2, 3, and 4, and first through fourth capacitors 831, 832, 833, and 834 having one ends respectively connected to the first through fourth external connection pins 1, 2, 3, and 4. The LED fluorescent lamp 800 may further include a diode unit disposed to allow flow of a forward current into the LED array 810.

In the LED fluorescent lamp 800 shown in FIG. 8, fifth through eighth diodes 845, 846, 847, and 848 may be disposed in opposite directions to fifth through eighth diodes 745, 746, 747, and 748 of the LED fluorescent lamp 700 shown in FIG. 7. Even if the diodes 845, 846, 847, and 848 are connected in opposite polar directions, only a current path may be changed, and basic operations may be the same as described above with reference to FIG. 7.

Figure 9:
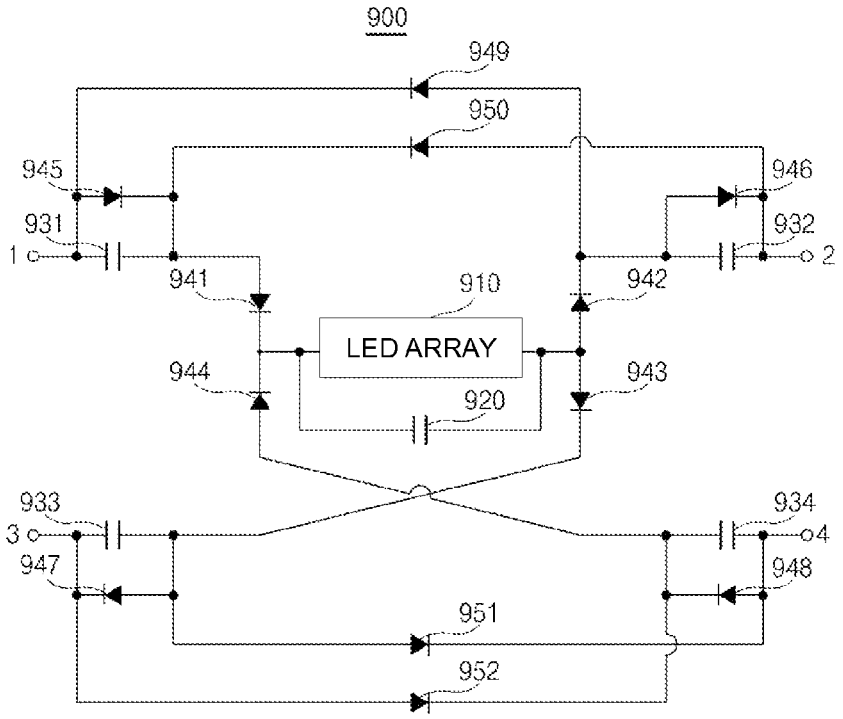
FIG. 9 is a circuit diagram of an LED fluorescent lamp according to another exemplary embodiment of the present invention.

FIG. 9 is a circuit diagram of an LED fluorescent lamp 900 according to another exemplary embodiment of the present invention.

Referring to FIG. 9, the LED fluorescent lamp 900 according to the present embodiment may include an LED array 910, a current stabilizing capacitor 920 connected in parallel to the LED array 910, first through fourth connection pins 1, 2, 3, and 4, and first through fourth capacitors 931, 932, 933, and 934 having one ends respectively connected to the first through fourth external connection pins 1, 2, 3, and 4. The LED fluorescent lamp 900 may further include a diode unit disposed to allow flow of a forward current into the LED array 910.

The diode unit may include a first diode 941 having an anode connected to the other end of the first capacitor 931 and a cathode connected to one end of the LED array 910, a second diode 942 having an anode connected to the other end of the LED array 910 and a cathode connected to the other end of the second capacitor 932, a third diode 943 having an anode connected to the other end of the LED array 910 and a cathode connected to the other end of the third capacitor 933, and a fourth diode 944 having an anode connected to the other end of the fourth capacitor 934 and a cathode connected to the one end of the LED array 910.

Furthermore, the diode unit may further include fifth through eighth diodes 945, 946, 947, and 948 connected in parallel to the first through fourth capacitors 931, 932, 933, and 934.

In addition, the diode unit may further include a ninth diode 949 having an anode connected to the other end of the second capacitor 932 and a cathode connected to the one end of the first capacitor 931, a tenth diode 950 having an anode connected to the one end of the second capacitor 932 and a cathode connected to the other end of the first capacitor 931, an eleventh diode 951 having an anode connected to the other end of the third capacitor 933 and a cathode connected to the one end of the fourth capacitor 934, and a twelfth diode 952 having an anode connected to the one end of the third capacitor 933 and a cathode connected to the other end of the fourth capacitor 934.

In the present embodiment, the first through fourth diodes 941, 942, 943, and 944 and the ninth through twelfth diodes 949, 950, 951, and 952 may be further used. Thus, the LED fluorescent lamp according to the present embodiment may stably operate irrespective of a phase in the phase of an alternating current (AC) voltage applied to the first through fourth connection pins 1, 2, 3, and 4 in various ballasts for fluorescent lamps.

In a modified example of the present embodiment, one end of the current stabilizing capacitor 920 may be connected to the anode of the first diode 941, and the other end of the current stabilizing capacitor 920 may be connected to the cathode of the second diode 942. In another modified example of the present embodiment, one end of the current stabilizing capacitor 920 may be connected to the cathode of the third diode 943, and the other end of the current stabilizing capacitor 920 may be connected to the anode of the fourth diode 944.

FIGS. 10A through 10D are graphs for explaining operations of an LED fluorescent lamp according to an exemplary embodiment of the present invention.

Figure 10A:
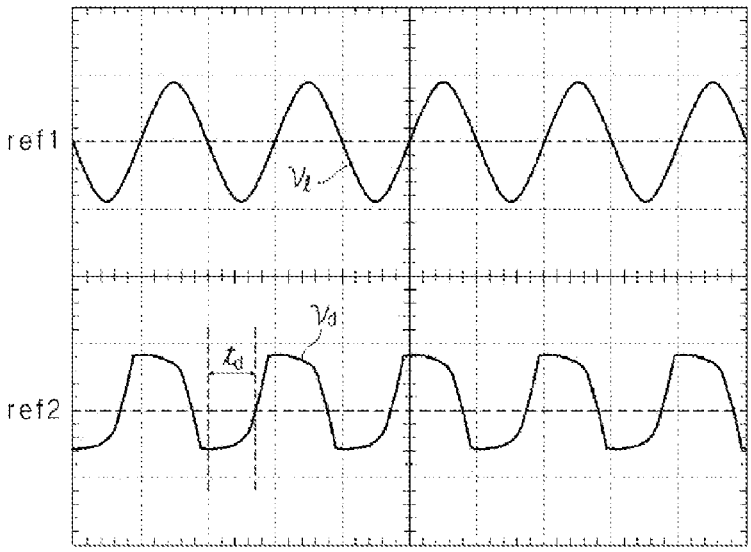
FIGS. 10A through 10D are graphs for explaining operations of an LED fluorescent lamp according to an exemplary embodiment of the present invention.
Figure 10B:
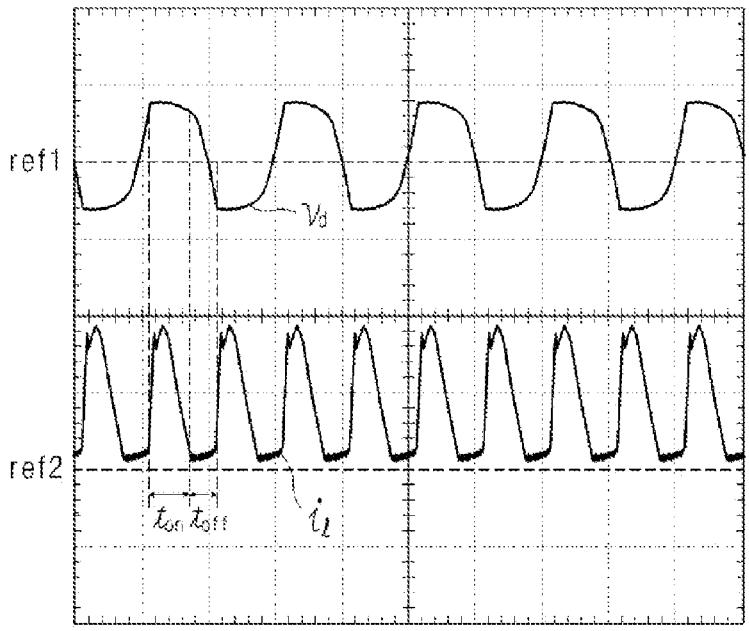
Figure 10C:
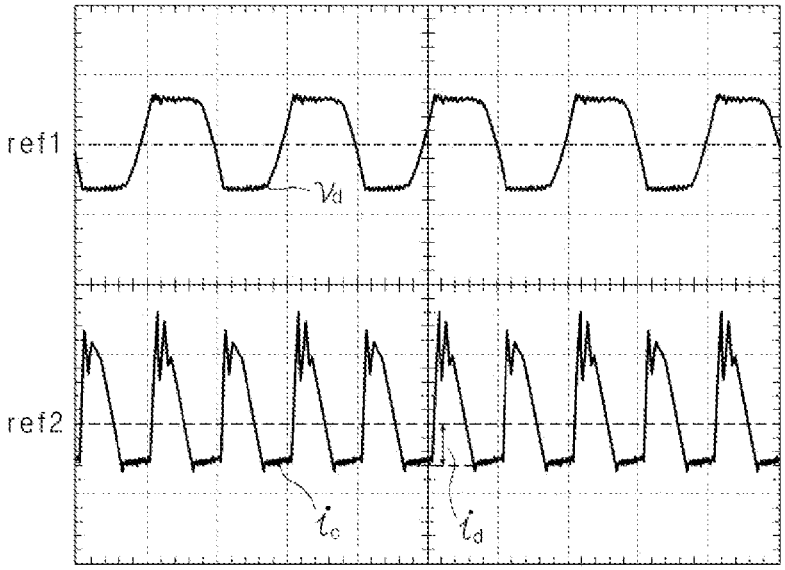
Figure 10D:
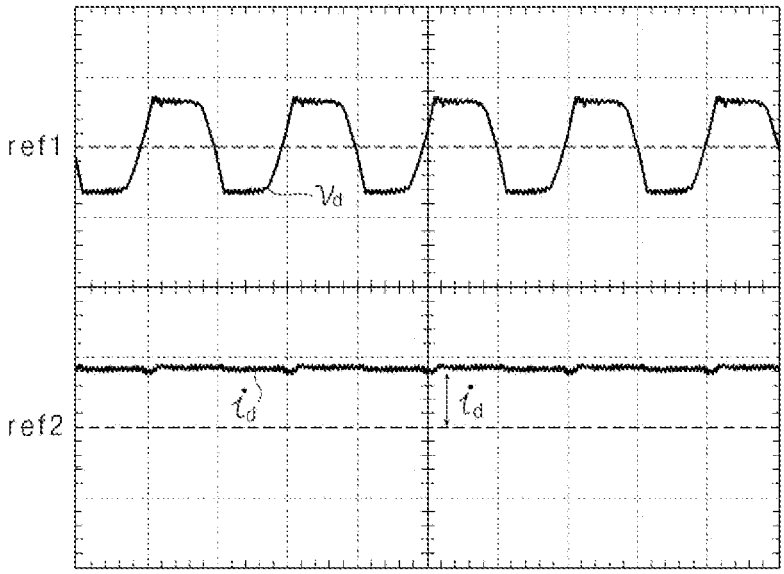

FIGS. 10A and 10B show measurements obtained when the LED fluorescent lamp 600 of FIG. 6, from which the current stabilizing capacitor 620 is eliminated, is connected to an instant start electronic ballast. FIGS. 10C and 10D show measurements obtained when the LED fluorescent lamp 600 of FIG. 6 is connected to the instant start electronic ballast.

FIG. 10A shows waveforms of a voltage applied to both ends of the LED fluorescent lamp 600 (i.e., a voltage $v_l$ applied from the instant start ballast to one of the first external connection pin 1 and the third external connection pin 3 and one of the second external connection pin 2 and the fourth external connection pin 4) and a voltage $V_d$ applied to both ends of the LED array 610 from the current control capacitors 631 to 634. Due to the functions of the current control capacitors 631 to 634 connected to both ends of the LED array 610, it can be seen that a phase of the voltage $V_d$ applied to LED array 610 lags behind a phase of the voltage $v_l$ applied to the both ends of the LED fluorescent lamp 600 by a value $t_d$.

FIG. 10B shows waveforms of a voltage $V_d$ applied to the both ends of the LED array 610 and current $i_l$ flowing through the LED array 610. Even if the voltage $V_d$ applied to the both ends of the LED fluorescent lamp is a negative voltage (−) due to a plurality of diodes 647 to 650 disposed in the LED fluorescent lamp 600, since current flows into the LED array in a forward direction, it can be seen that a frequency of the current flowing through the LED array 610 is twice as high as a frequency of the voltage $V_d$ applied to the both ends of the LED array 610. As a result, when a high-frequency current flows through the LED array 610, a crest factor of an LED current may greatly increase, thereby causing high-frequency flicker and degrading light velocity efficiency. In FIG. 10B, $t_{on}$ refers to a period in which current flows through the LED array 610, while $t_{off}$ refers to a period in which no current flows through the LED array 610.

FIG. 10C shows waveforms of a voltage $V_d$ applied to both ends of the LED array 610 when the current stabilizing capacitor 620 is connected in parallel to the LED array 610 and current $i_c$ flowing through the current stabilizing capacitor 620. On comparing the waveform of the current $i_l$ flowing through the LED array 610 shown in FIG. 10B with the waveform of the current $i_c$ flowing through the current stabilizing capacitor 620, it can be seen that a basic waveform remains unchanged and current is shifted by a stabilized LED current id of FIG. 10C and supplied.

FIG. 10D shows waveforms of a voltage $V_d$ applied to both ends of the LED array 610 when the current stabilizing capacitor 620 was connected in parallel to the LED array 610 and current id flowing through the LED array 610.

Referring to FIGS. 10B, 10C, and 10D, when the current stabilizing capacitor 620 is connected in parallel to the LED array 610, current including a high-frequency element, out of current flowing through the LED fluorescent lamp 600, may flow into the current stabilizing capacitor 620, and a constant current from which the high-frequency element is eliminated may flow into the LED array 610. Equation 1 may be applied to the waveforms of FIGS. 10B, 10C, and 10D to exhibit current characteristics.

Therefore, when the current stabilizing capacitor 620 is connected, the whole high-frequency current element may flow through the current stabilizing capacitor 620, and a constant current may flow through the LED array 610 so that flicker can be prevented and light velocity efficiency can be maximized

TABLE 1

| | Disconnection of capacitor | Connection of capacitor |
|---|---|---|
| Total light velocity [Lm] | 1548 | 1622 |
| Input power [W] | 21.6 | 20.31 |
| Light velocity efficiency [Lm/W] | 73.16 | 79.86 |
| Crest factor of LED current | 2.63 | 1.36 |

Table 1 shows measurements obtained when a case in which the current stabilizing capacitor 620 was not connected to the LED fluorescent lamp 600 and a case in which the current stabilizing capacitor 620 was connected to the LED fluorescent lamp 600 were compared. In the present embodiment, the LED fluorescent lamp was connected to an instant start electronic ballast, and the LED array 610 may include two parallel-connected groups of 56 LED arrays connected in series. The current stabilizing capacitor 620 had a capacitance of about 1500 pF.

As shown in Table 1, under the same conditions, when the current stabilizing capacitor 620 was connected, light velocity efficiency was about 9.2% higher than when the current stabilizing capacitor 620 was not connected, and a crest factor (1.36) of an LED current was about 43% lower than a crest factor (2.63) of the LED current obtained when the current stabilizing capacitor 620 was not connected.

The present invention provides a long-lived highly efficient LED fluorescent lamp, which can be intactly applied to ballasts for conventional fluorescent lamps without installing an additional exclusive ballast or changing lines disposed in a lighting fixture, may not cause flicker. Therefore, conventional fluorescent lamps can be simply exchanged with LED fluorescent lamps without incurring additional cost, thereby facilitating the usage of environmentally friendly highly efficient illuminators.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A light emitting diode (LED) lamp, comprising:

an external connection pin including a first connection pin, a second connection pin, a third connection pin and a fourth connection pin;

an LED array including a plurality of light emitting diodes (LEDs) connected in series;

a current stabilizing capacitor connected in parallel to the LED array; and a capacitive element unit connected between the LED array and the external connection pin and configured to vary an impedance of a lamp ballast connected to the capacitive element unit through the external connection pin, wherein the capacitive element unit comprises at least one of:

a first capacitor having one end connected to the first connection pin and the other end connected to a terminal of an anode side of the LED array, a second capacitor having one end connected to the second connection pin and the other end connected to a terminal of a cathode side of the LED array, a third capacitor having one end connected to the third connection pin and the other end connected to the terminal of the anode side of the LED array, and a fourth capacitor having one end connected to the fourth connection pin and the other end connected to the terminal of the cathode side of the LED array.

2. The lamp of claim 1, further comprising a diode unit connected to both ends of the LED array and configured to form a one-way current path in the LED array.

3. The lamp of claim 2, wherein the diode unit comprises at least one of:

a first diode having a cathode connected to one end of the LED array and an anode connected in common to the other end of the first capacitor and the other end of the third capacitor; and a second diode having an anode connected to the other end of the LED array and a cathode connected in common to the other end of the second capacitor and the other end of the fourth capacitor.

4. The lamp of claim 3, which includes all of the first through fourth capacitors, wherein the diode unit further comprises at least one of:

a third diode having an anode connected to the one end of the first capacitor and a cathode connected to the other end of the first capacitor;

a fourth diode having a cathode connected to the one end of the second capacitor and an anode connected to the other end of the second capacitor;

a fifth diode having an anode connected to the one end of the third capacitor and a cathode connected to the other end of the third capacitor; and a sixth diode having a cathode connected to the one end of the fourth capacitor and an anode connected to the other end of the fourth capacitor.

5. The lamp of claim 3, which includes all of the first through fourth capacitors, wherein the diode unit further comprises at least one of:

a seventh diode having an anode connected to the other end of the second capacitor and a cathode connected to the one end of the first capacitor;

an eighth diode having an anode connected to the one end of the second capacitor and a cathode connected to the other end of the first capacitor;

a ninth diode having an anode connected to the one end of the fourth capacitor and a cathode connected to the other end of the third capacitor; and a tenth diode having an anode connected to the other end of the fourth capacitor and a cathode connected to the one end of the third capacitor.

6. The lamp of claim 2, which includes all of the first through fourth capacitors, wherein the diode unit comprises:

a first diode having a cathode connected to one end of the LED array;

a second diode having an anode connected to the other end of the LED array;

a third diode having an anode connected to the other end of the first capacitor and a cathode connected to an anode of the first diode;

a fourth diode having an anode connected to a cathode of the second diode and a cathode connected to the other end of the second capacitor;

a fifth diode having an anode connected to the other end of the third capacitor and a cathode connected to the anode of the first diode;

a sixth diode having an anode connected to the cathode of the second diode and a cathode connected to the other end of the fourth capacitor;

a seventh diode having an anode connected to the cathode of the second diode and a cathode connected to the other end of the first capacitor;

an eighth diode having an anode connected to the other end of the second capacitor and a cathode connected to the cathode of the third diode;

a ninth diode having an anode connected to the other end of the fourth capacitor and a cathode connected to a cathode of the fifth diode; and a tenth diode having an anode connected to the cathode of the second diode and a cathode connected to the other end of the third capacitor.

7. The lamp of claim 2, which includes all of the first through fourth capacitors, wherein the diode unit comprises:

a first diode having an anode connected to the other end of the first capacitor and a cathode connected to one end of the LED array;

a second diode having an anode connected to the other end of the LED array and a cathode connected to the other end of the second capacitor;

a third diode having an anode connected to the other end of the second capacitor and a cathode connected to the one end of the LED array; and a fourth diode having an anode connected to the other end of the LED array and a cathode connected to the other end of the third capacitor.

8. The lamp of claim 7, further comprising:

a fifth diode having an anode connected to the one end of the first capacitor and a cathode connected to the other end of the first capacitor;

a sixth diode having an anode connected to the one end of the second capacitor and a cathode connected to the other end of the second capacitor;

a seventh diode having an anode connected to the one end of the third capacitor and a cathode connected to the other end of the third capacitor; and an eighth diode having an anode connected to the one end of the fourth capacitor and a cathode connected to the other end of the fourth capacitor.

9. The lamp of claim 7, further comprising:

a fifth diode having an anode connected to the other end of the first capacitor and a cathode connected to the one end of the first capacitor;

a sixth diode having an anode connected to the other end of the second capacitor and a cathode connected to the one end of the second capacitor;

a seventh diode having an anode connected to the other end of the third capacitor and a cathode connected to the one end of the third capacitor; and an eighth diode having an anode connected to the other end of the fourth capacitor and a cathode connected to the one end of the fourth capacitor.

10. The lamp of claim 2, which includes all of the first through fourth capacitors, wherein the diode unit comprises:

a first diode having an anode connected to the other end of the first capacitor and a cathode connected to one end of the LED array;

a second diode having an anode connected to the other end of the LED array and a cathode connected to the other end of the second capacitor;

a third diode having an anode connected to the other end of the LED array and a cathode connected to the other end of the third capacitor; and a fourth diode having an anode connected to the other end of the fourth capacitor and a cathode connected to one end of the LED array.

11. The lamp of claim 10, wherein the diode unit further comprises:

a fifth diode having an anode connected to one end of the first capacitor and a cathode connected to the other end of the first capacitor;

a sixth diode having an anode connected to the other end of the second capacitor and a cathode connected to the one end of the second capacitor;

a seventh diode having an anode connected to the other end of the third capacitor and a cathode connected to the one end of the third capacitor; and an eighth diode having an anode connected to the one end of the fourth capacitor and a cathode connected to the other end of the fourth capacitor.

12. The lamp of claim 11, wherein the diode unit comprises:

a ninth diode having an anode connected to the other end of the second capacitor and a cathode connected to the one end of the first capacitor;

a tenth diode having an anode connected to the one end of the second capacitor and a cathode connected to the other end of the first capacitor;

an eleventh diode having an anode connected to the other end of the third capacitor and a cathode connected to the one end of the fourth capacitor; and a twelfth diode having an anode connected to the one end of the third capacitor and a cathode connected to the other end of the fourth capacitor.

* * * * *